US007213429B2

(12) United States Patent
Armstrong et al.

(10) Patent No.: US 7,213,429 B2
(45) **Date of Patent: *May 8, 2007**

(54) REKEYABLE LOCK ASSEMBLY

(75) Inventors: Steven Armstrong, Anaheim, CA (US); Gerald B. Chong, Rowland Heights, CA (US)

(73) Assignee: Newfrey LLC, Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/783,243

(22) Filed: Feb. 20, 2004

(65) Prior Publication Data

US 2005/0011242 A1 Jan. 20, 2005

Related U.S. Application Data

(62) Division of application No. 10/256,066, filed on Sep. 26, 2002, now Pat. No. 6,860,131.

(51) Int. Cl.
*E05B 27/04* (2006.01)
*E05B 29/04* (2006.01)

(52) U.S. Cl. ..... 70/492; 70/383; 70/384; 70/493; 70/495

(58) Field of Classification Search ..... 70/337–343, 70/382–385, 368, 492, 493, 495, 491, 494, 70/496

See application file for complete search history.

(56) References Cited

U.S. PATENT DOCUMENTS

| | | | |
|---|---|---|---|
| 1,565,556 | A | 12/1925 | Fremon |
| 1,610,224 | A | 12/1926 | Dalboni et al. |
| 1,965,889 | A | 7/1934 | Fitzgerald |
| 2,139,842 | A | 12/1938 | Miller |
| 2,194,469 | A | 3/1940 | Fremon |
| 2,232,017 | A | 2/1941 | Wilder |
| 2,370,862 | A | 3/1945 | Johnstone |
| 2,391,832 | A | 12/1945 | Johnstone |
| 2,895,323 | A | 7/1959 | Kennedy |
| 2,977,786 | A | 4/1961 | Kendrick et al. |
| 3,149,486 | A | 9/1964 | Russell et al. |
| 3,183,692 | A | 5/1965 | Check |
| 3,190,093 | A | 6/1965 | Schlage |

(Continued)

FOREIGN PATENT DOCUMENTS

| | | |
|---|---|---|
| EP | 0157967 | 10/1985 |

(Continued)

*Primary Examiner*—Lloyd A. Gall
(74) *Attorney, Agent, or Firm*—Richard J. Veltman; John D. DelPonti

(57) ABSTRACT

A rekeyable lock cylinder includes a cylinder body with a plug body and carrier sub-assembly disposed therein. The plug body includes a plurality of spring-loaded pins and the carrier assembly includes a plurality of racks for engaging the pins to operate the lock cylinder. The racks and pins move in a transverse direction, in response to insertion of a first valid key into the lock cylinder, to unlock the lock cylinder. The carrier moves in a longitudinal direction, in response to insertion of a tool in a tool-receiving aperture, from an operating position to a rekeying position. In the rekeying position, the racks are disengaged from the pins and a second valid key can replace the first valid key. Rotation of the plug body from the rekeying position with the second valid key in the lock cylinder obsoletes the first valid key.

36 Claims, 24 Drawing Sheets

U.S. PATENT DOCUMENTS 3,261,188 A * 7/1966 Kerr ..... 70/491
3,320,781 A 5/1967 Hill
3,589,153 A 6/1971 Hill
3,667,262 A 6/1972 Hill
3,726,116 A 4/1973 Dimotta
3,728,880 A 4/1973 Falk
3,735,612 A 5/1973 Popovici
3,754,422 A 8/1973 Stackhouse
3,910,083 A 10/1975 Burlingame
3,990,282 A 11/1976 Sorum
3,999,413 A 12/1976 Raymond et al.
4,015,458 A 4/1977 Mercurio
4,069,694 A 1/1978 Raymond et al.
4,094,175 A 6/1978 Pechner
4,142,391 A 3/1979 Paig
4,320,639 A 3/1982 Kleefeldt et al.
4,372,139 A 2/1983 Laake
4,376,382 A 3/1983 Raymond et al.
4,377,940 A 3/1983 Hucknall
4,393,673 A 7/1983 Widen
4,404,824 A 9/1983 Hennessy
4,412,437 A 11/1983 Smith
4,440,009 A 4/1984 Smith
4,689,978 A 9/1987 Drummond
4,712,399 A 12/1987 Mattossovich
4,712,401 A 12/1987 Monahan
4,712,402 A 12/1987 Monahan
4,729,231 A 3/1988 Wu
4,732,023 A 3/1988 Shen
4,741,188 A 5/1988 Smith
4,747,281 A 5/1988 Monahan
4,765,163 A 8/1988 Trull et al.
4,794,772 A 1/1989 Falk et al.
4,836,002 A 6/1989 Monahan
4,850,210 A 7/1989 Adler et al.
4,899,563 A 2/1990 Martin
4,909,053 A 3/1990 Zipf, III et al.
4,912,953 A 4/1990 Wobig
4,920,774 A 5/1990 Martin
4,942,749 A 7/1990 Rabinow
4,966,021 A 10/1990 Boag
4,996,856 A 3/1991 Lin et al.
5,010,753 A 4/1991 Boris, Jr.
5,024,071 A 6/1991 Shafirkin
5,038,589 A 8/1991 Martin
5,044,180 A 9/1991 Lebrecht
5,076,081 A 12/1991 Boris, Jr.
5,121,619 A 6/1992 Martin
5,174,136 A 12/1992 Thwing
5,209,088 A 5/1993 Vaks
5,211,044 A 5/1993 Kim
5,233,850 A 8/1993 Schroeder
5,325,690 A 7/1994 Adler et al.
5,428,978 A 7/1995 Tsukano
5,431,034 A 7/1995 Fann et al.
5,540,071 A 7/1996 Reikher
5,640,865 A 6/1997 Widen
5,704,234 A 1/1998 Resch
5,718,136 A 2/1998 Aldieri et al.
5,752,400 A 5/1998 Kim
5,765,417 A 6/1998 Bolton
5,791,181 A 8/1998 Sperber et al.
5,884,512 A 3/1999 Wayne
5,921,122 A 7/1999 Lin
5,921,123 A 7/1999 Schwarzkopf et al.
5,970,760 A 10/1999 Shen
5,979,200 A 11/1999 Cliff
6,029,484 A 2/2000 Jetton
6,047,577 A 4/2000 Klimas
6,076,386 A 6/2000 Etchells et al.
6,079,240 A 6/2000 Shvarts
6,119,495 A 9/2000 Loreti
6,134,928 A 10/2000 Kang
6,142,717 A 11/2000 Staiger
6,295,850 B1 10/2001 Anderson
6,425,274 B1 7/2002 Laitala et al.
6,516,643 B1 2/2003 Olshausen
6,523,378 B2 2/2003 Kuo
6,532,782 B2 3/2003 Chiu
6,564,601 B2 5/2003 Hyatt, Jr.
6,776,017 B2 8/2004 Herdman
6,860,131 B2 * 3/2005 Armstrong et al. ..... 70/492
6,862,909 B2 * 3/2005 Armstrong et al. ..... 70/492
6,871,520 B2 * 3/2005 Armstrong et al. ..... 70/492
6,959,569 B2 * 11/2005 Strader et al. ..... 70/492
7,114,357 B2 * 10/2006 Armstrong et al. ..... 70/492
7,117,701 B2 * 10/2006 Armstrong et al. ..... 70/492
2003/0037582 A1 2/2003 Edwards, Jr. et al.
2003/0084692 A1 5/2003 Herdman
2003/0089149 A1 5/2003 Suzuki et al.
2003/0154753 A1 8/2003 Dimig et al.
2004/0069030 A1 4/2004 Takadama

FOREIGN PATENT DOCUMENTS

EP 0210037 1/1987
EP 0872615 10/1998
WO WO9314290 7/1993
WO WO9736072 10/1997

* cited by examiner

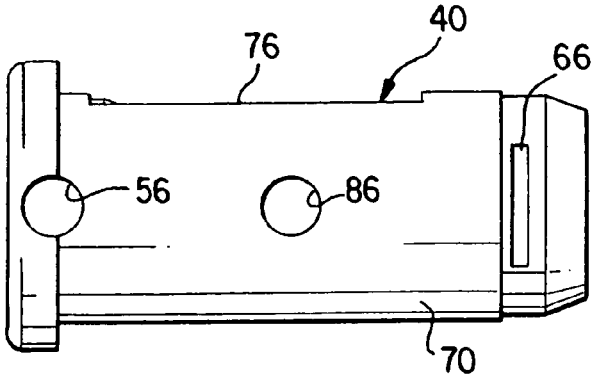
FIG. 16D
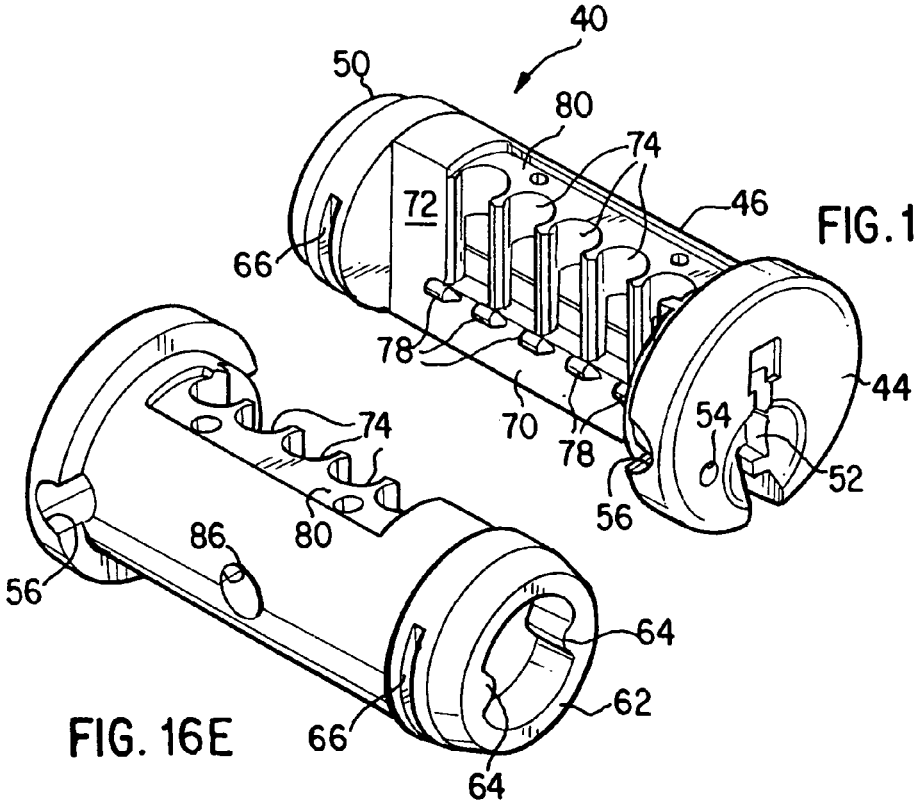
FIG. 16F
FIG. 16E

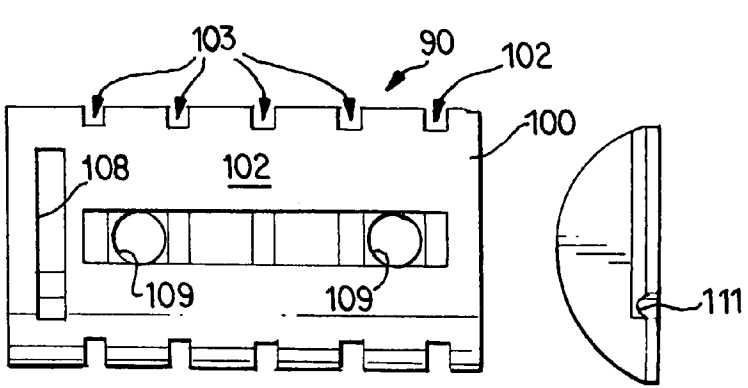
FIG.17A
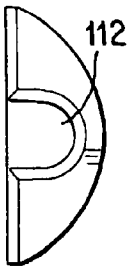
FIG.17B
FIG.17C
FIG.17D
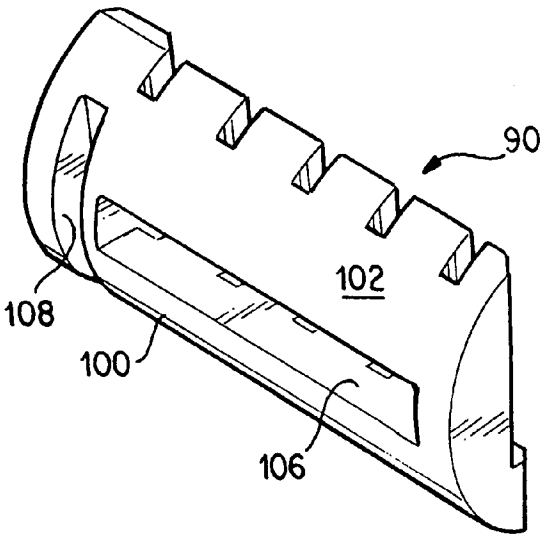
FIG.17E
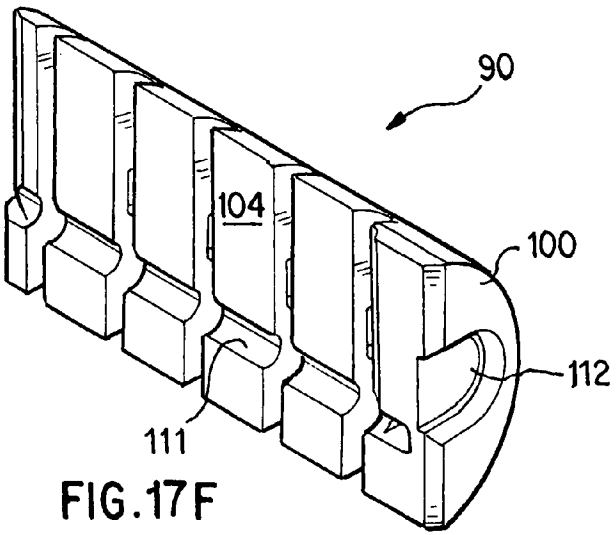
FIG.17F

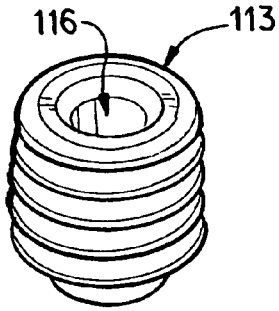
FIG. 20A
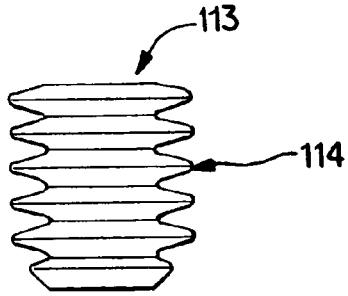
FIG. 20B
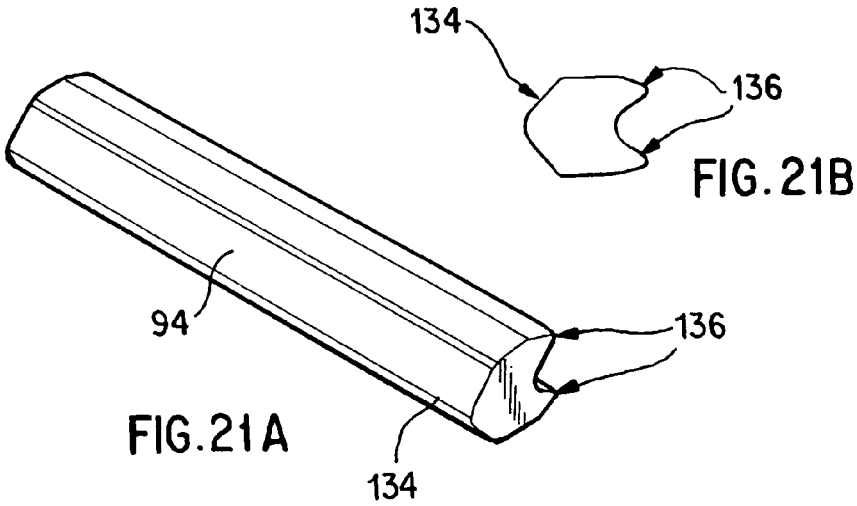
FIG. 21B
FIG. 21A

REKEYABLE LOCK ASSEMBLY

This application is a divisional of U.S. application Ser. No. 10/256,066, filed Sep. 26, 2002 now U.S. Pat. No. 6,860,131.

The classification of the claims contained in this application is class 70, subclass 492. Parent application Ser. No. 10/256,066 issued to U.S. Pat. No. 6,860,131 on Mar. 1, 2005.

The present invention relates generally to lock cylinders and particularly to lock cylinders that can be rekeyed. More particularly, the invention relates to lock cylinders that can be rekeyed without the use of a master key.

BACKGROUND OF THE INVENTION

When rekeying a cylinder using a traditional cylinder design, the user is required to remove the cylinder plug from the cylinder body and replace the appropriate pins so that a new key can be used to unlock the cylinder. This typically requires the user to remove the cylinder mechanism from the lockset and then disassemble the cylinder to some degree to remove the plug and replace the pins. This requires a working knowledge of the lockset and cylinder mechanism and is usually only performed by locksmiths or trained professionals. Additionally, the process usually employs special tools and requires the user to have access to pinning kits to interchange pins and replace components that can get lost or damaged in the rekeying process. Finally, professionals using appropriate tools can easily pick traditional cylinders.

The present invention overcomes these and other disadvantages of conventional lock cylinders. The lock cylinder of the present invention operates in a transparent way that presents the familiar experience of inserting a key and rotating the key in the lock cylinder, as with current cylinders. However, in the present invention, that same familiar experience is used to rekey the lock cylinder. Thus, the user does not require any special knowledge, training, or tools to rekey the lock cylinder of the present invention.

SUMMARY OF THE INVENTION

The present invention provides a simple means for "teaching" a lock cylinder a new key while obsoleting old keys. According to the present invention, a rekeyable lock cylinder comprises a cylinder body with a longitudinal axis and a plug assembly disposed in the cylinder body. The plug assembly includes a plug body and a carrier sub-assembly disposed adjacent the plug body. The plug assembly further includes a plurality of pins. The carrier sub-assembly is moveable parallel to the longitudinal axis of the cylinder body and includes a plurality of racks for engaging the pins. The racks disengage from the pins in response to movement of the carrier in a first direction and engage the pins in response to movement of the carrier in a second direction. The lock cylinder is in a rekeyable condition when the racks are disengaged from the pins.

The present invention further includes a novel method of rekeying a rekeyable lock cylinder. According to the invention, a method of rekeying a rekeyable lock cylinder comprises the steps of providing a lock cylinder with a plug body and a lock face having a keyway and a tool-receiving aperture, inserting a first valid key in the keyway, rotating the plug body to a first position, inserting a tool in the tool-receiving aperture, removing the first valid key from the keyway, inserting a second valid key in the keyway, and rotating the plug body away from the first position. The step of inserting the tool includes the step of moving a rack out of engagement with a pin.

According to one aspect of the invention, the lock cylinder includes a carrier that is moveable parallel to a longitudinal axis of the lock cylinder and the step of inserting the tool includes the step of moving the carrier.

Other features and advantages will become apparent from the following description when viewed in accordance with the accompanying drawings and appended claims.

BRIEF DESCRIPTION OF THE DRAWINGS

FIGS. 16*a*–16*f* are various views of the cylinder plug body for use in the present invention.

FIGS. 17*a*–17*f* are various view of the carrier for use in the present invention.

FIGS. 20*a*–20*b* are views of a pin for use in the present invention.

FIGS. 21*a*–21*b* are views of a locking bar for use in the present invention.

DETAILED DESCRIPTION OF THE DRAWINGS

Figure 1:
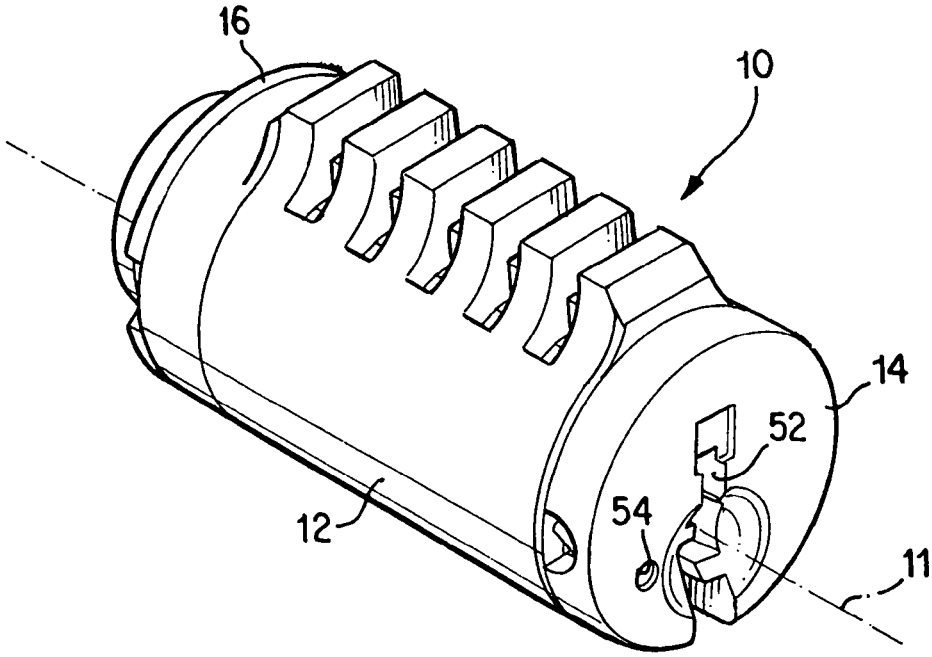
FIG. 1 illustrates a lock cylinder according to the present invention.
Figure 2:
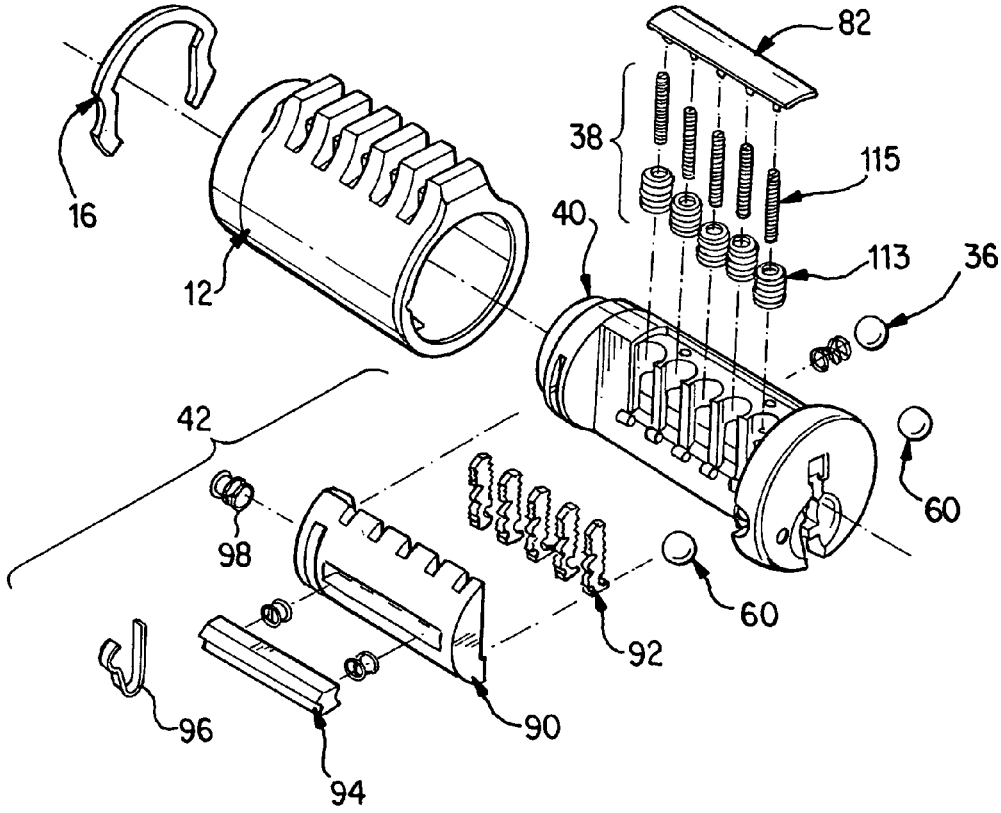
FIG. 2 is an exploded view of the lock cylinder of FIG. 1.

A lock cylinder 10 according to the present invention is illustrated in FIG. 1–2. The lock cylinder 10 includes a longitudinal axis 11, a lock cylinder body 12, a plug assembly 14 and a retainer 16. In FIG. 1, the plug assembly 14 is in the home position relative to the cylinder body 12.

The lock cylinder body 12, as seen in FIGS. 15*a*–15*e*, includes a generally cylindrical body 20 having a front end 22, a back end 24 and a cylinder wall 26 defining an interior surface 28. The cylinder wall 26 includes an interior, locking bar-engaging groove 29 and a pair of detent recesses 30, 32. The generally V-shaped locking bar-engaging groove 29 extends longitudinally along a portion of the cylinder body 12 from the front end 22. The first detent recess 30 is disposed at the back end 24 and extends to a first depth. The second detent recess 32 is disposed adjacent the first detent recess 30 and extends to a lesser depth. A detent bore 34 extends radially through the cylinder wall 26 for receiving a detent ball 36 (FIG. 2).

The plug assembly 14 includes a plug body 40, a carrier sub-assembly 42 and a plurality of spring-loaded pins 38 (FIGS. 2 and 20*a*–20*b*). The plug body 40, illustrated in FIGS. 16*a*–16*f*, includes a plug face 44, an intermediate portion 46 and a drive portion 50. The plug face 44 defines a keyway opening 52, a rekeying tool opening 54 and a pair of channels 56 extending radially outwardly for receiving anti-drilling ball bearings 60 (FIG. 2). The drive portion 50 includes an annular wall 62 with a pair of opposed projections 64 extending radially inwardly to drive a spindle or torque blade (neither shown). The drive portion 50 further includes a pair of slots 66 formed in its perimeter for receiving the retainer 16 to retain the plug body 40 in the cylinder body 12.

The intermediate portion 46 includes a main portion 70 formed as a cylinder section and having a first longitudinal planar surface 72 and a plurality of channels 74 for receiving the spring-loaded pins 38. The channels 74 extend transversely to the longitudinal axis of the plug body 40 and parallel to the planar surface 72. A second planar surface 76 extends perpendicular to the first planar surface 72 and defines a recess 80 for receiving a retaining cap 82 (FIGS. 2 and 22*a*–22*d*). The channels 74 extend from the second planar surface 76 partially through the plug body 40, with the sidewalls of the channels open to the first planar surface 72. The first planar surface 72 further includes a plurality of bullet-shaped, rack-engaging features 78. A bore 86 for receiving a spring-loaded detent ball 36 (FIG. 2) extends radially inwardly from opposite the first planar surface 72.

Figure 6:
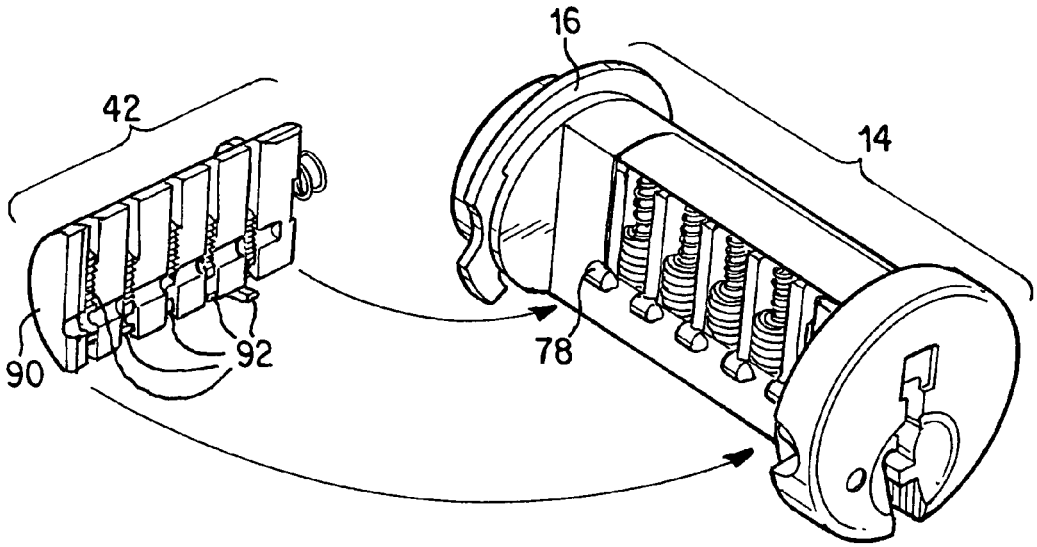
FIG. 6 is a partially exploded view of the plug assembly of FIG. 3.
Figure 10:
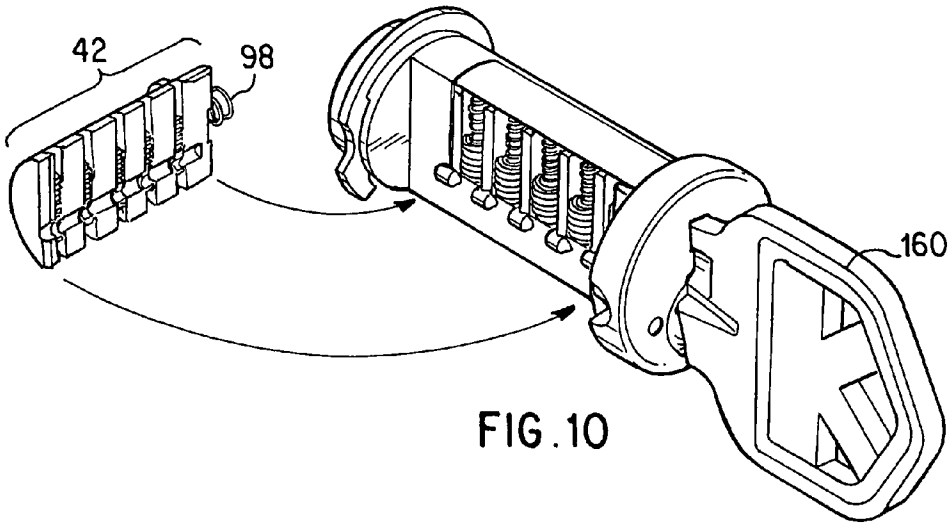
FIG. 10 is a partially broken away side view of the plug assembly of FIG. 8.
Figure 11:
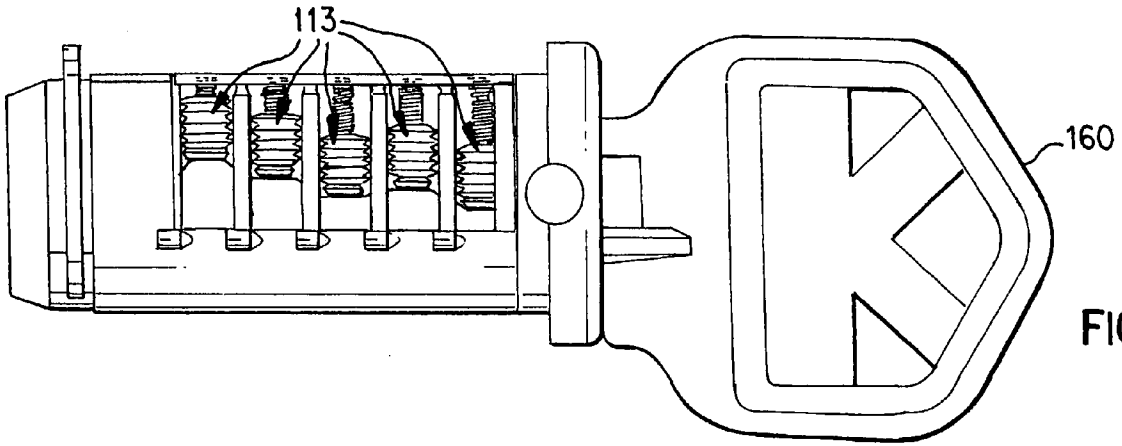
FIG. 11 is a partially exploded view of the plug assembly of FIG. 8.
Figure 18A:
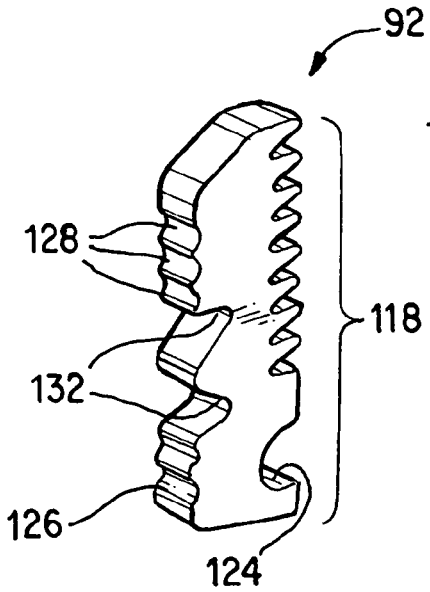
FIGS. 18*a*–18*b* are views of a rack for use in the present invention.
Figure 18B:
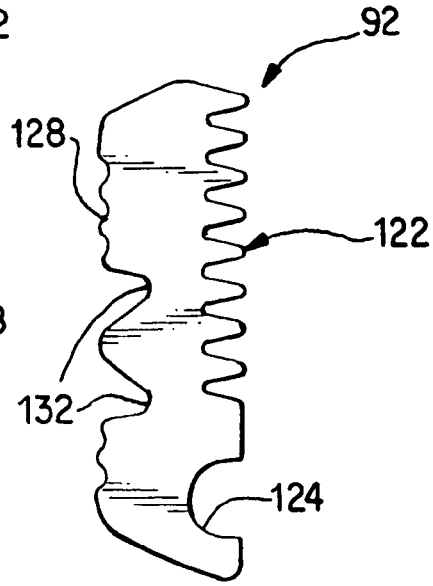
Figure 19A:
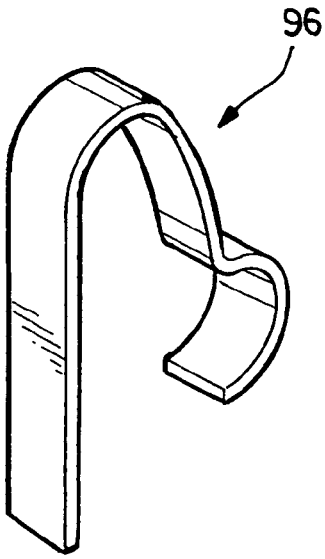
FIGS. 19*a*–19*b* are views of a spring catch for use in the present invention.
Figure 19B:
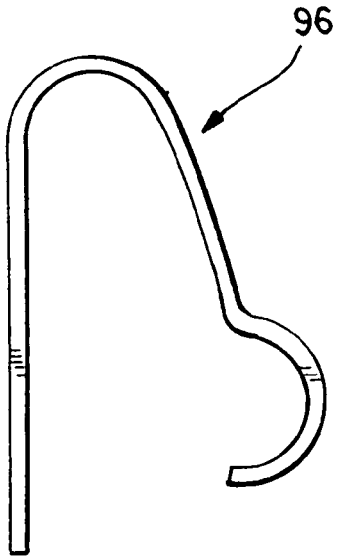
Figure 22A:
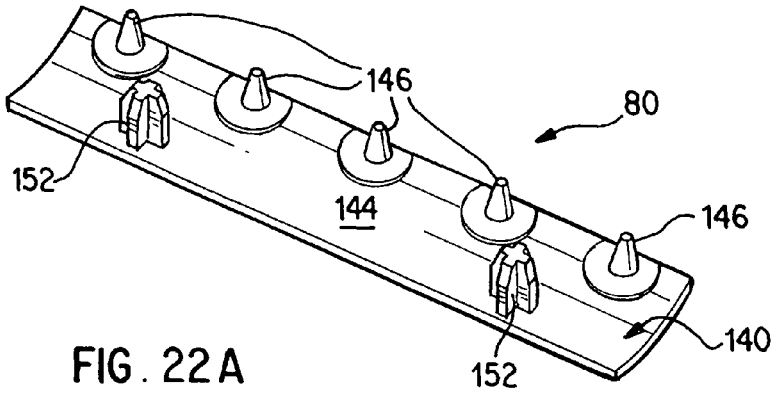
FIGS. 22*a*–22*d* are views of a spring retaining cap for use in the present invention.
Figure 22B:
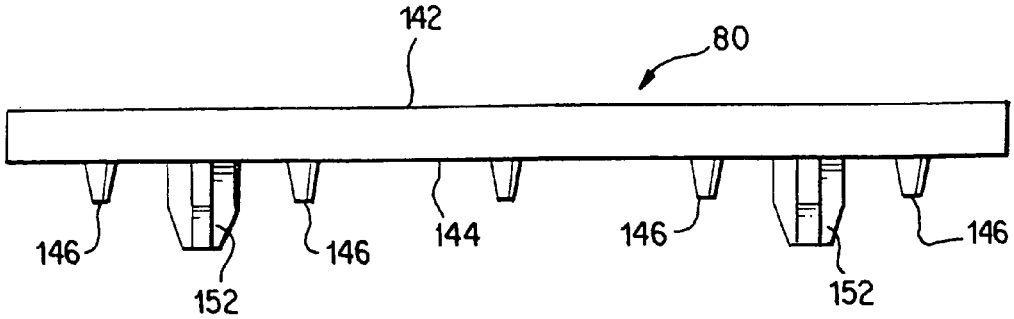
Figure 22C:
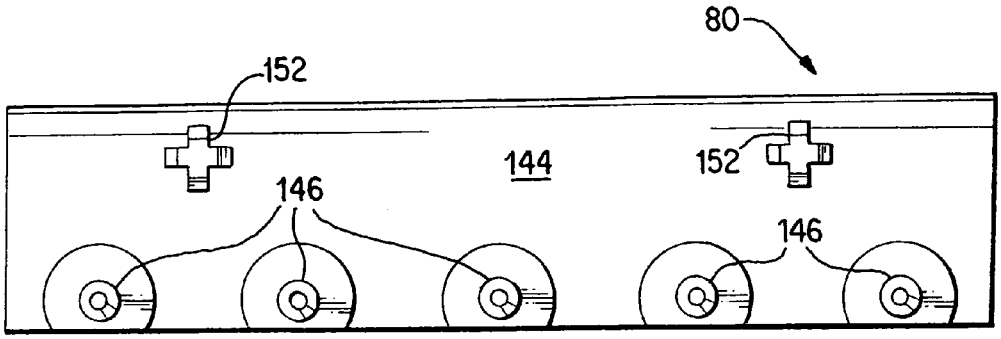
Figure 22D:
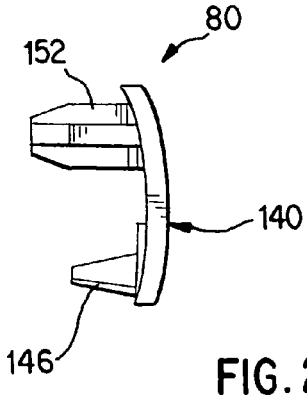

The carrier sub-assembly 42 (FIGS. 2, 6 and 10) includes a carrier 90 (FIGS. 17*a*–17*e*), a plurality of racks 92 (FIGS. 18*a*–18*b*), a spring catch 96 (FIGS. 19*a*–19*b*), a spring-loaded locking bar 94 (FIGS. 21*a*–21*b*), and a return spring 98 (FIG. 2). The carrier 90 includes a body 100 in the form of a cylinder section that is complementary to the main portion 70 of the plug body 40, such that the carrier 90 and the main portion 70 combine to form a cylinder that fits inside the lock cylinder body 12. The carrier 90 includes a curved surface 102 and a flat surface 104. The curved surface 102 includes a locking bar recess 106 and a spring catch recess 108. The locking bar recess 106 further includes a pair of return spring-receiving bores 109 (FIG. 17*c*) for receiving the locking bar return springs. The flat surface 104 includes a plurality of parallel rack-receiving slots 102 extending perpendicular to the longitudinal axis of the carrier. A semi-circular groove 111 extends along the flat surface 104 parallel to the longitudinal axis of the carrier 90. The back end of the carrier 90 includes a recess 112 for receiving the return spring 98.

Figure 7:
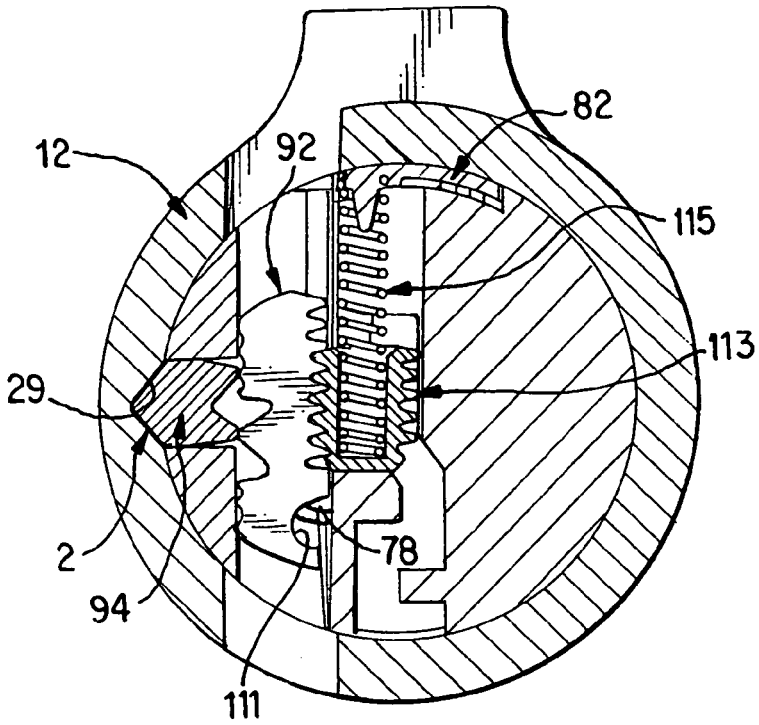
FIG. 7 is a section view through the plug assembly of FIG. 3 and a cylinder body, the section being taken transversely at one of the pins and illustrating the positioning of the pin, a rack, and the locking bar relative to each other and the cylinder body in a locked configuration.
Figure 12:
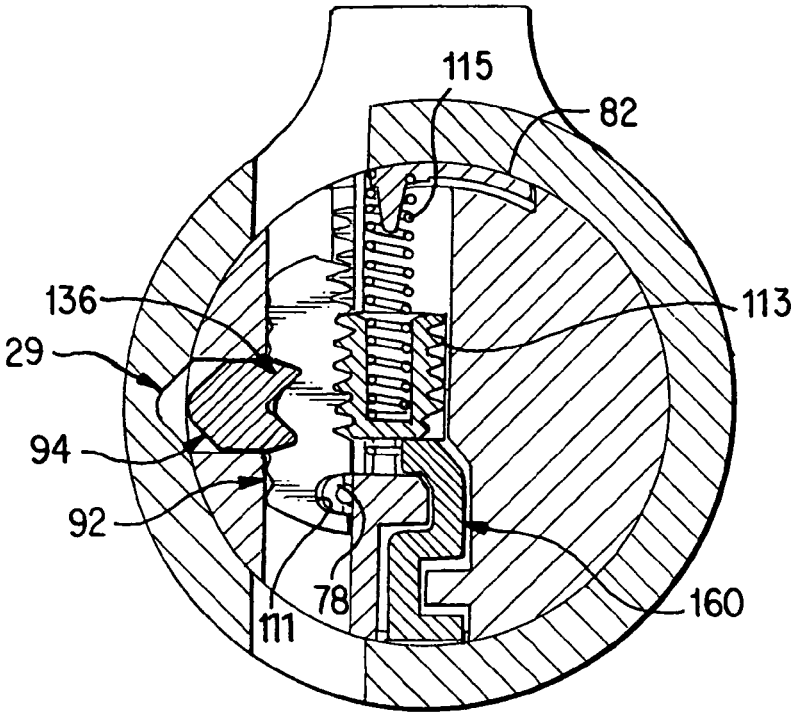
FIG. 12 is a section view through the plug assembly of FIG. 8 and a cylinder body, the section being taken transversely at one of the pins and illustrating the positioning of the pin, the rack, and the locking bar relative to each other and the cylinder body in an unlocked configuration.

Each spring-loaded pin 38 includes a pin 113 and a biasing spring 115. The pins 113, illustrated in FIGS. 20*a*–20*b*, are generally cylindrical with annular gear teeth 114 and a central longitudinal bore 116 for receiving biasing springs 115 (FIG. 2). The racks 92, illustrated in FIGS. 18*a*–18*b*, include a pin-engaging surface 118 having a plurality of gear teeth 122 configured to engage the annular gear teeth 114 on the pins 113, as illustrated in FIGS. 7 and 12, and a semi-circular recess 124 for engaging the bullet-shaped, rack-engaging features 78 on the planar surface 72, as illustrated in FIG. 12. The racks 92 further include a second surface 126 that includes a plurality of anti-pick grooves 128 and a pair of locking bar-engaging grooves 132.

The spring-loaded locking bar 94, illustrated in FIGS. 21*a*–22*b*, is sized and configured to fit in the locking bar recess 106 in the carrier 90 and includes a triangular edge 134 configured to fit in the V-shaped locking bar-engaging groove 29. Opposite the triangular edge 134, the locking bar 94 includes a pair of longitudinally extending gear teeth 136 configured to engage the locking bar-engaging grooves 132 formed in the racks 92, as illustrated in FIG. 12.

The spring-retaining cap 82, illustrated in FIGS. 22*a*–22*d*, includes a curvilinear portion 140 having an upper surface 142 and a lower surface 144. The thickness of the curvilinear portion 140 is set to allow the curvilinear portion 140 to fit in the recess 80 with the upper surface 142 flush with the intermediate portion 46 of the plug body 40, as illustrated in FIGS. 7 and 12. A plurality of spring alignment tips 146 extend from the lower surface 144 to engage the springs 115. In addition, a pair of cap retaining tips 152 extend from the lower surface 144 to engage alignment openings 154 formed in the plug body 40 (FIGS. 16*e*–16*f*).

Figure 3:
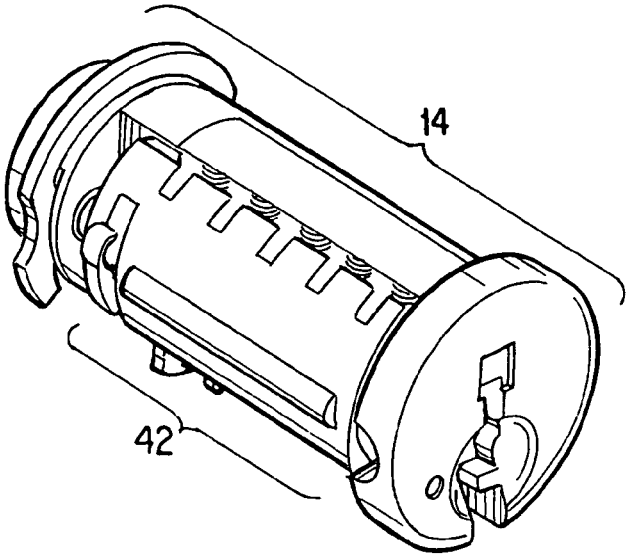
FIG. 3 is a perspective view of a plug assembly illustrating a carrier sub-assembly with a locking bar disposed in a locking position to lock the plug assembly in a lock cylinder body.

To assemble the lock cylinder 10, the pins 113 and spring 115 are disposed in the channels 74 of the plug body 40. The spring-retaining cap 82 is placed in the recess 80, with the cap retaining tips 152 disposed in the alignment openings 154 and the spring alignment tips 146 engaged with the springs 115. The carrier sub-assembly 42 is assembled by placing the racks 92 into the slots 102 and the spring-loaded locking bar 94 into the locking bar recess 106, with the gear teeth 136 engaging the locking bar-engaging grooves 132 formed in the racks 92. The spring catch 96 is disposed in the spring catch recess 108 of the carrier 90. A valid key 160 is inserted into the keyway 52, the return spring 98 is compressed into the return spring recess 112, and the carrier sub-assembly is placed adjacent the plug body 40, as illustrated in FIG. 3. The plug assembly 14 is placed in the lock cylinder body 12 and the retainer 16 is disposed in the slots 66 formed in the plug body 40 to retain the plug assembly 14 in the cylinder body 12. The lock cylinder 10 is now keyed to the valid key 160.

Figure 4:
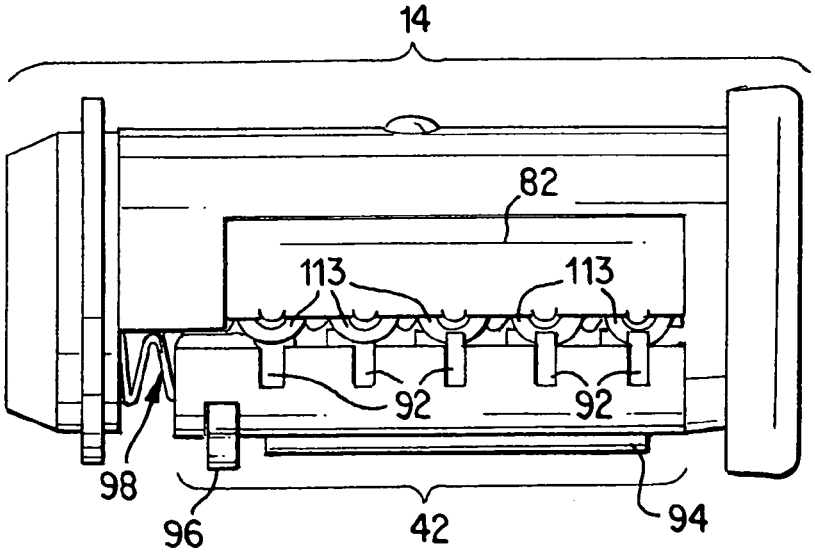
FIG. 4 is a top plan view of the plug assembly of FIG. 3.
Figure 5:
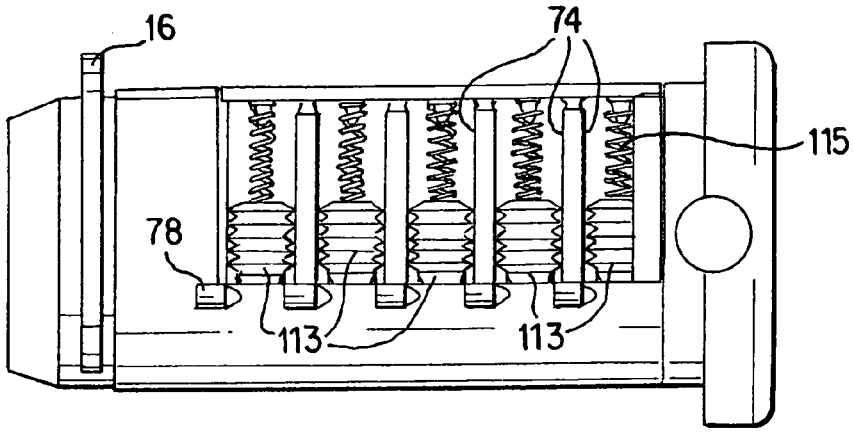
FIG. 5 is a partially broken away side view of the plug assembly of FIG. 3.

The properly keyed lock cylinder 10, without the key 160 inserted, is illustrated in FIGS. 4–7. The pins 113 are biased to the bottom of the channels 74 and, based on the cut of the key 160, the racks 92 are disposed at various positions in the slots 103 of the carrier 90. In this configuration, the locking bar 94 extends from the carrier 90 to engage the groove 29 in the cylinder body 12 to prevent the plug assembly 14 from rotating in the cylinder body 12 and the racks 92 engage the pins 113, as illustrated in FIG. 4. In addition, the bullet-shaped features 78 are misaligned with the grooves 111 in the racks 92 and therefore interfere with movement of the racks 92 parallel to the longitudinal axis of the lock cylinder 10, preventing the lock cylinder 10 from being rekeyed.

Figure 8:
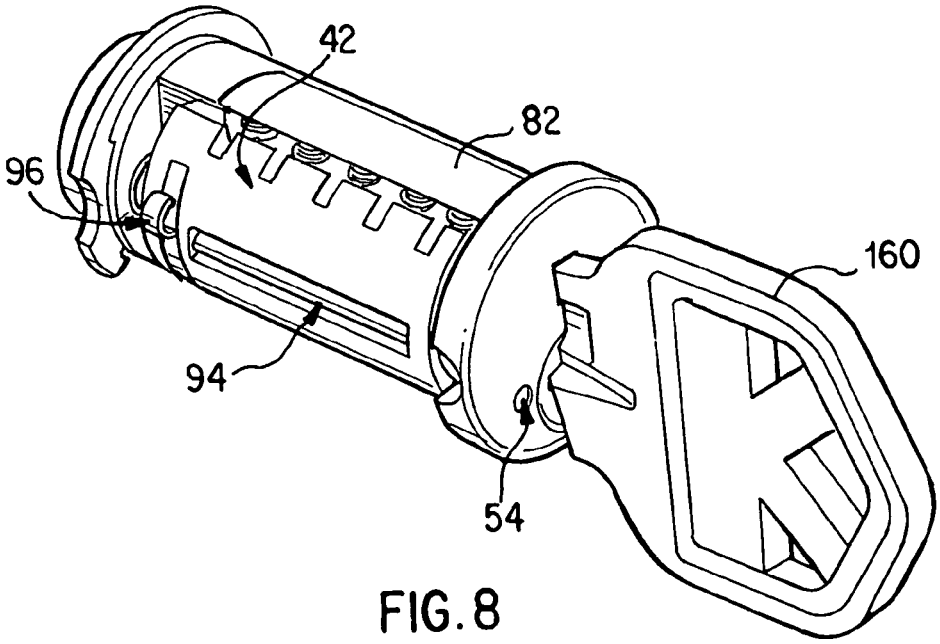
FIG. 8 is a perspective view of the plug assembly of FIG. 3 with a valid key inserted therein and illustrating the locking bar disposed in an unlocking position to allow the plug assembly to rotate in the lock cylinder body.
Figure 9:
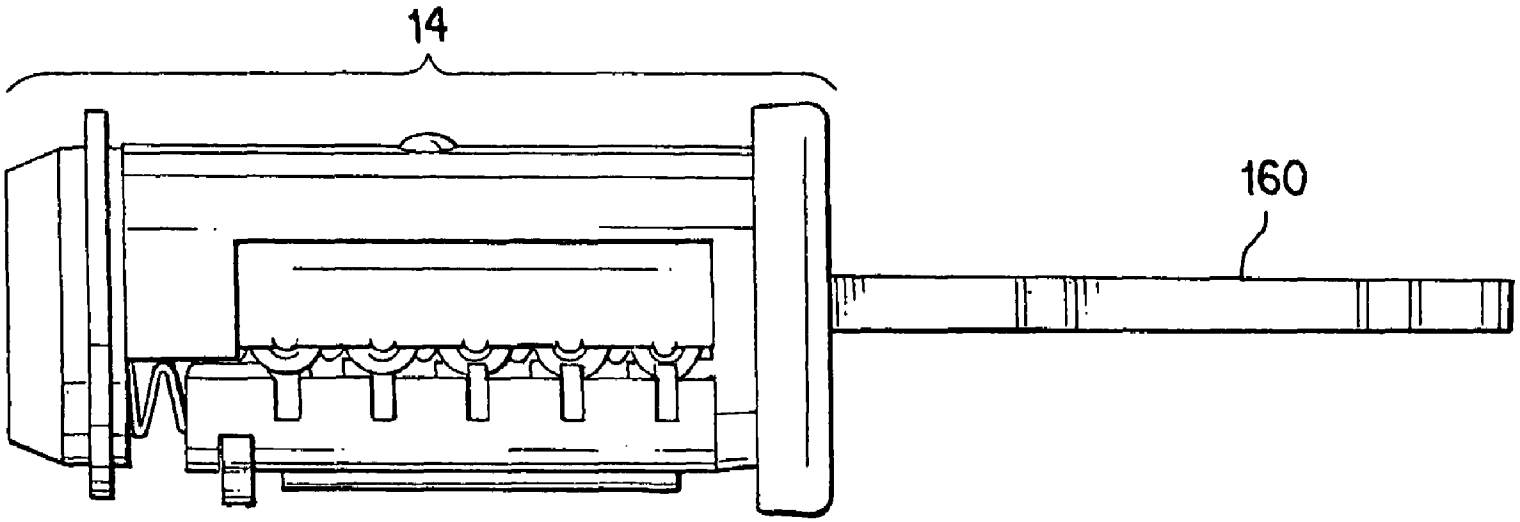
FIG. 9 is a top plan view of the plug assembly of FIG. 8.

The internal configuration of a lock cylinder 10 with the valid key 160 inserted therein at the home position is illustrated In FIGS. 8–12. In this configuration, the locking bar 94 is free to cam out of the groove 29 in the cylinder body 12, as depicted in FIGS. 8, 9 and 12. The bits of the key 160 lift the pins 113 in the channels 74 and thereby re-position the racks 92 in the slots 102. When repositioned, the racks 92 are disposed to align the locking bar-engaging grooves 132 with the extended gear teeth 136 on the locking bar 94. The locking bar 94 is free to cam out of the groove 29 as the key 160 is rotated. At the same time, the bullet-shaped features 78 are aligned with the grooves 111 in the racks 92, as illustrated in FIG. 12, allowing the racks 92, and the carrier 90, to move parallel to the longitudinal axis of the lock cylinder 10.

Figure 13:
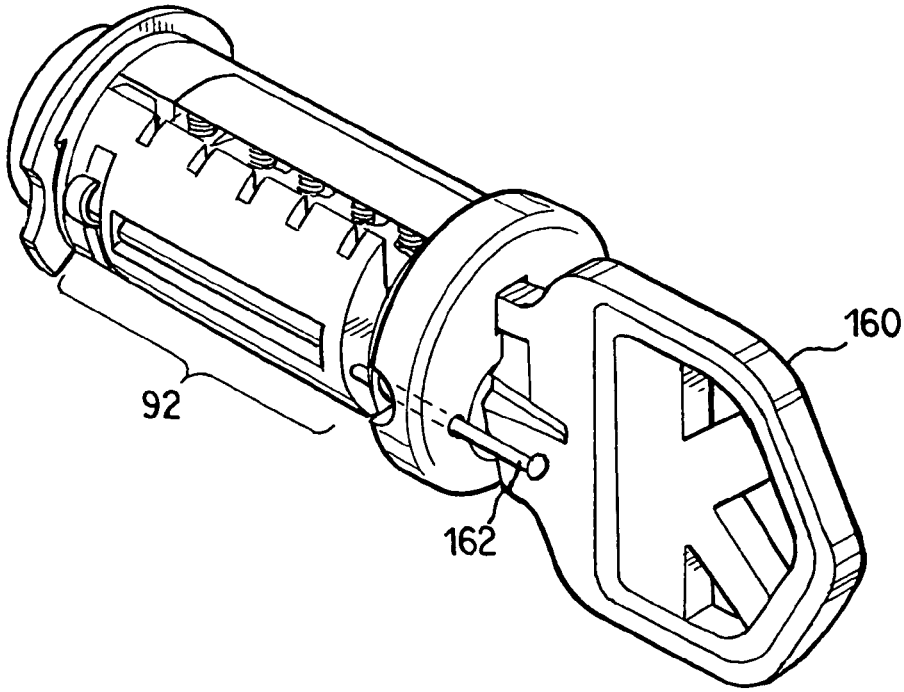
FIG. 13 is a perspective view similar to FIG. 8 but with the carrier assembly moved axially to a rekeying position.
Figure 14:
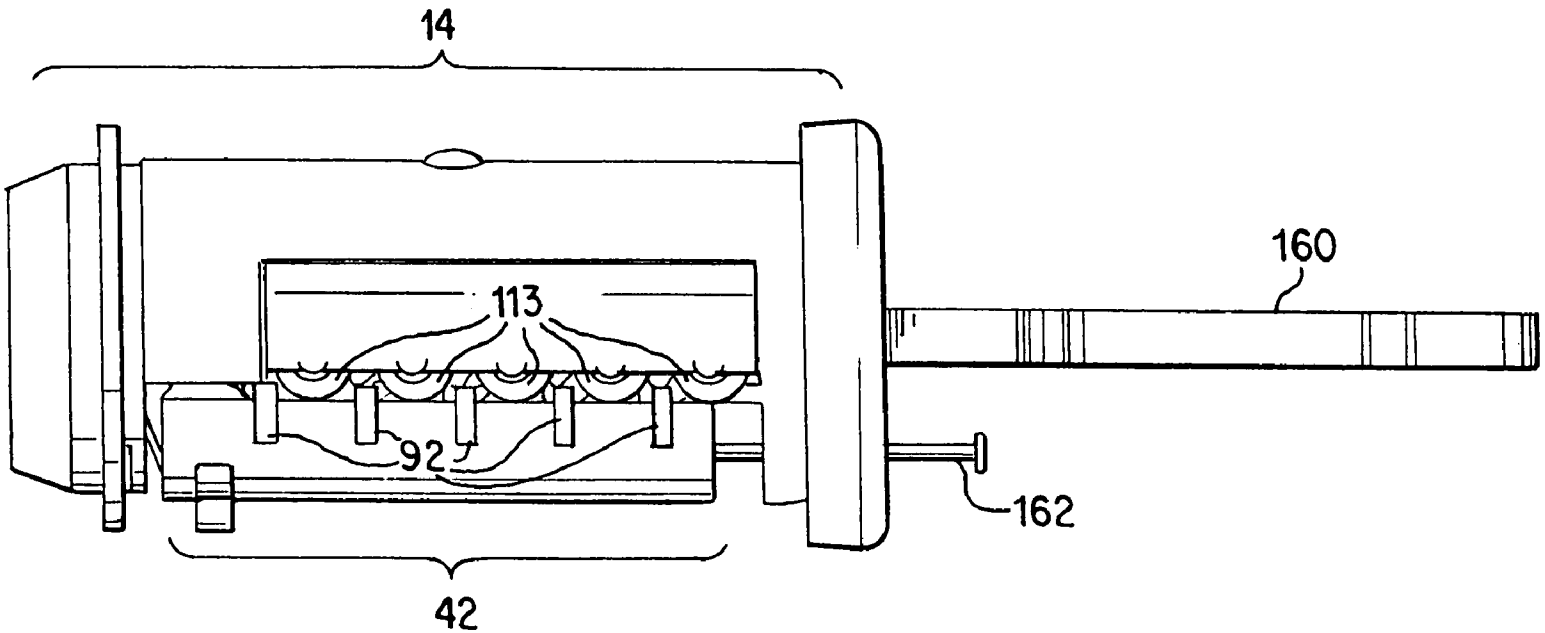
FIG. 14 is a top plan view of the plug assembly of FIG. 13.
Figure 15C:
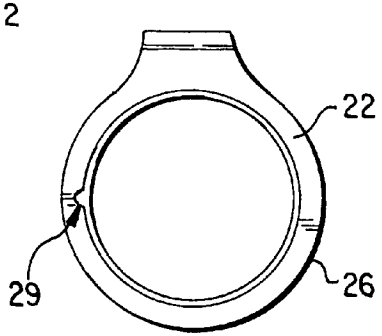
FIGS. 15*a*–15*e* are various views of a cylinder body for use in the present invention.
Figure 15B:
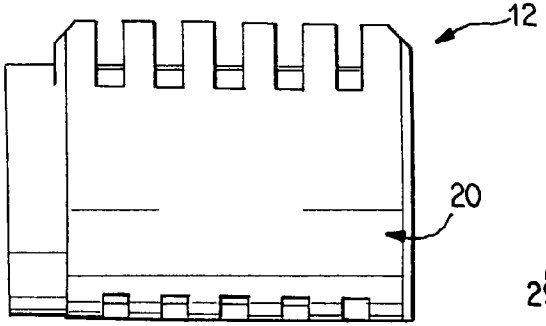
Figure 15A:
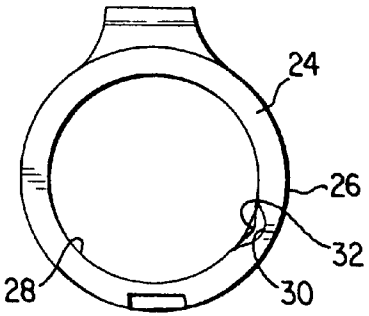
Figure 15E:
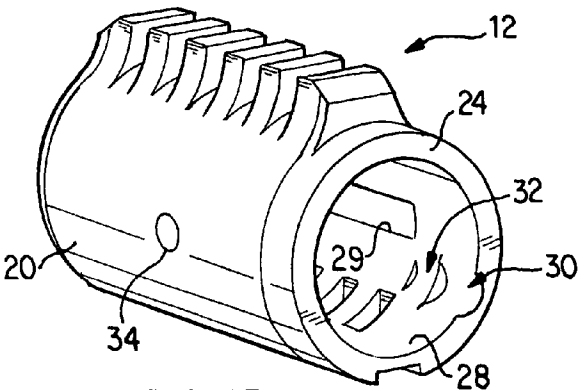
Figure 15D:
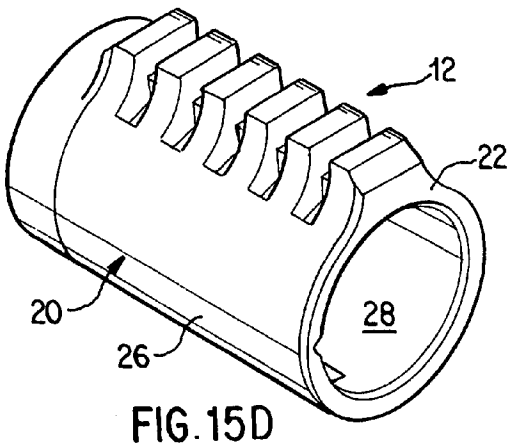
Figure 16A:
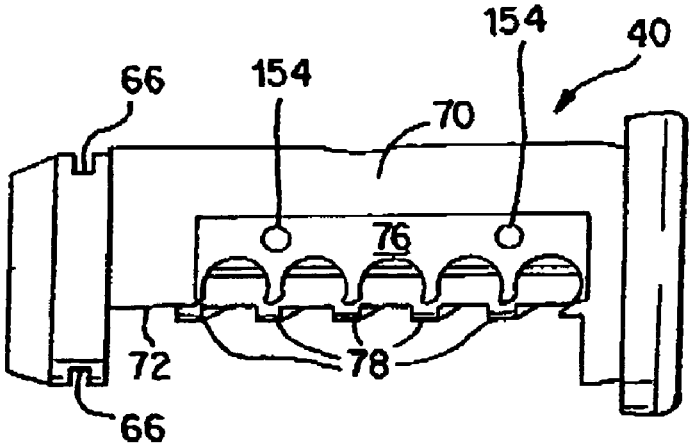
Figure 16B:
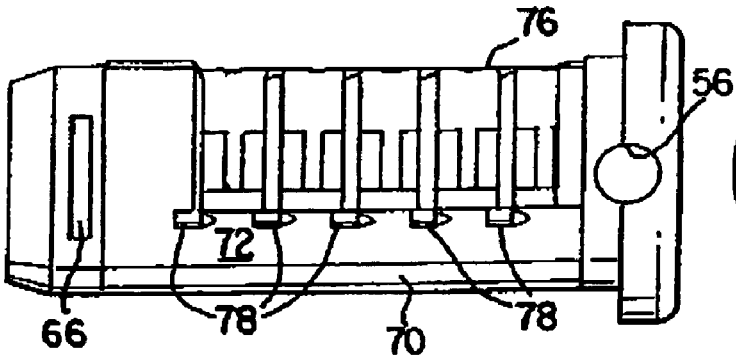
Figure 16C:
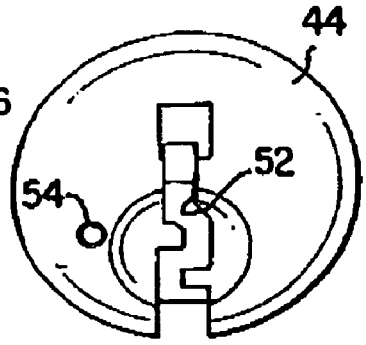

To rekey the lock cylinder 10, the valid key 160 is inserted into the keyway 52, as illustrated in FIGS. 13–14 and rotated approximately 45° counterclockwise from the home position until the spring catch 96 moves into the second detent recess 32 formed in the cylinder body 12. A paperclip or other pointed device 162 is inserted into the tool opening 54 and pushed against the carrier 90 to move the carrier 90 parallel to the longitudinal axis of the lock cylinder 10 until the spring catch 96 moves into the first detent recess 30, and the pointed device 162 is removed. With the spring catch 96 disposed in the first detent recess 30, the racks 92 are disengaged from the pins 113, as illustrated in FIG. 14. The valid key 160 is removed and a second valid key is inserted and rotated clockwise to release the spring catch 96. As the spring catch 96 leaves the first detent recess 30, the carrier 90 is biased toward the plug face 44 by the return spring 98, causing the racks 92 to re-engage the pins 113. At this point, the lock cylinder 10 is keyed to the second valid key and the first valid key 160 no longer operates the lock cylinder 10. The lock cylinder 10 can be rekeyed to fit a third valid key by replacing the first and second valid keys in the above procedures with the second and third valid keys, respectively.

Figure 23:
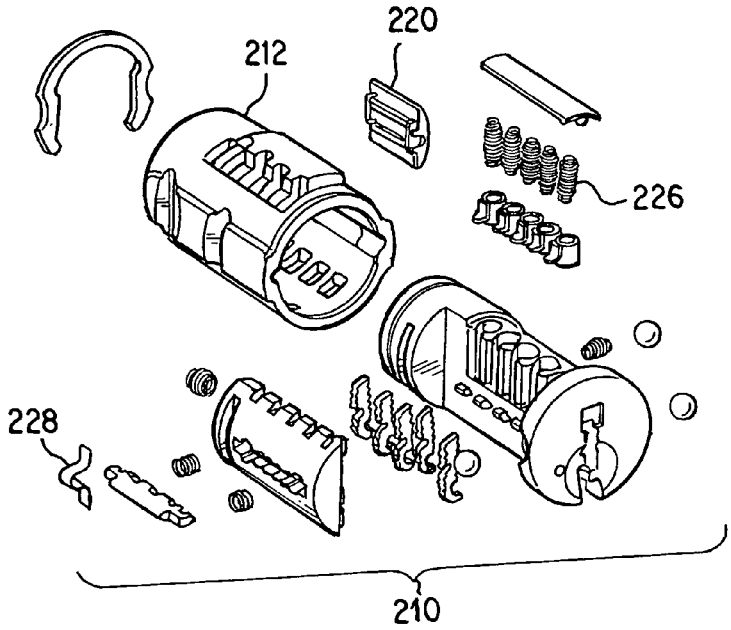
FIG. 23 is an exploded perspective view of an alternative embodiment of the invention.
Figure 24A:
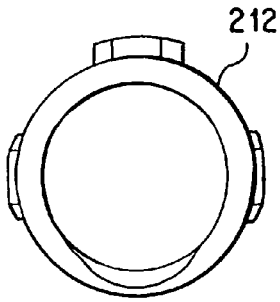
FIGS. 24*a*–24*e* are views of an alternative embodiment of the lock cylinder housing.
Figure 24B:
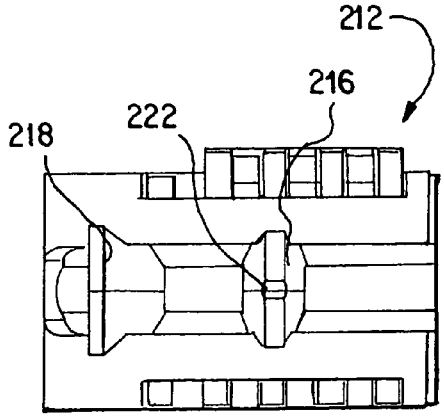
Figure 24C:
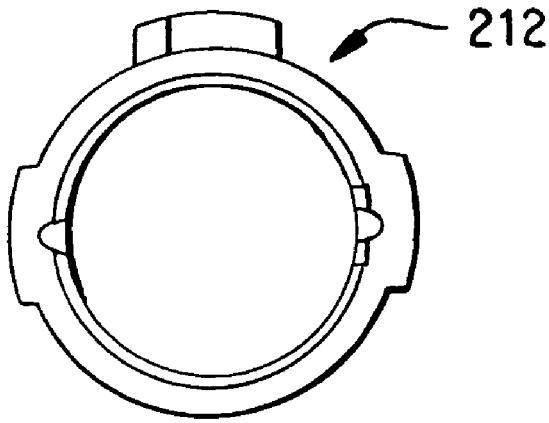
Figure 24D:
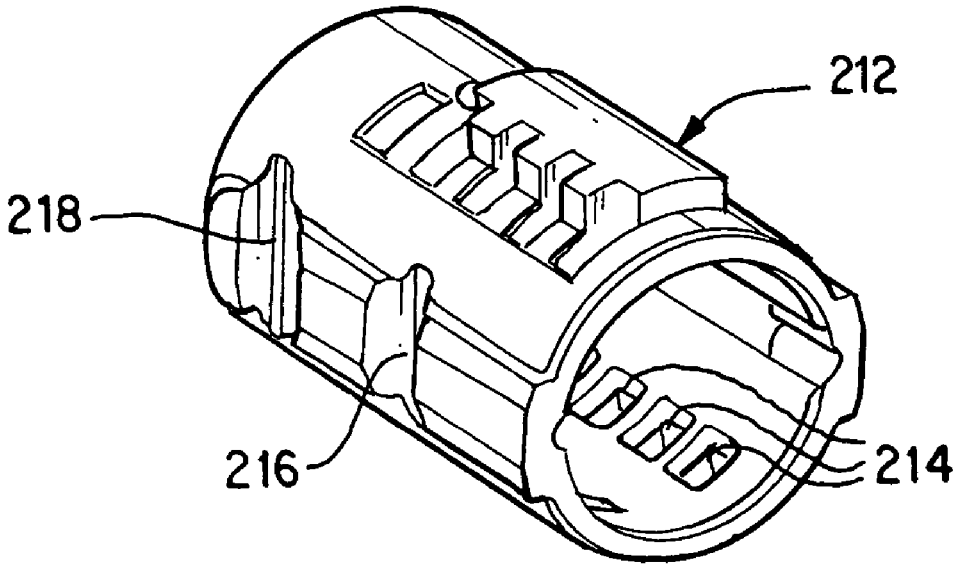
Figure 24E:
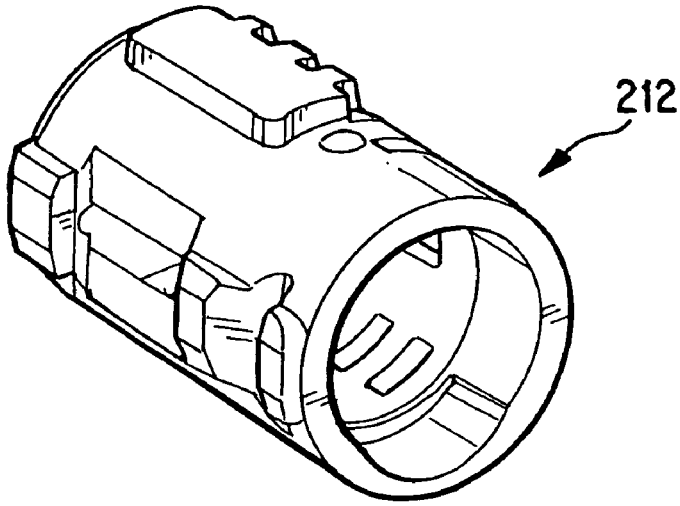

An alternative embodiment 210 of the invention is illustrated in FIGS. 23–29. The alternative embodiment includes the same components, as illustrated in FIG. 23, but several of the components have been modified. Functionally, both embodiments are the same.

The modified housing 212, illustrated in FIGS. 23 and 24, includes a plurality of apertures 214 running longitudinally along the bottom thereof and a pair of vertical grooves 216, 218 formed in the housing sidewall. In addition, the sidewall includes a removable side panel 220. The rectangular holes 214 are positioned to allow the use of a manual override tool. The center groove 216 includes an aperture 222 extending through the housing sidewall. The aperture 222 allows a user to move the locking bar during a manual override operation. The side panel 220 provides access for performing certain operations while changing the master key of the lock cylinder.

Figure 25:
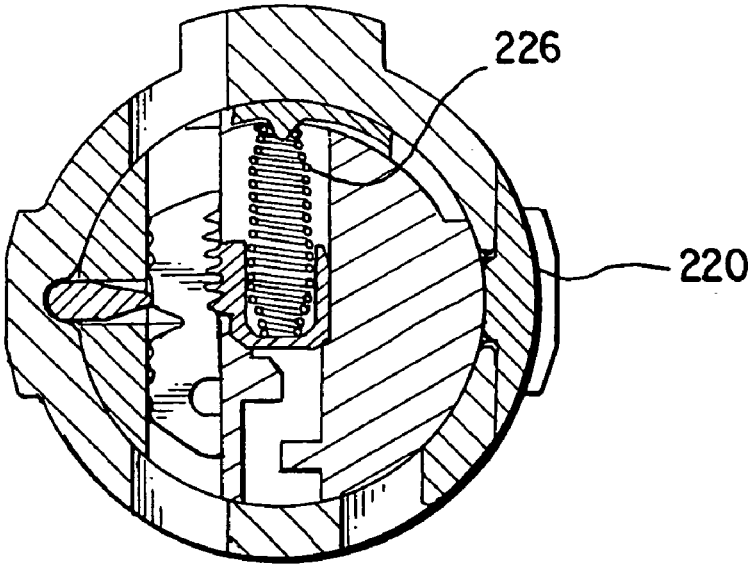
FIG. 25 is a transverse section view taken through an alternative embodiment of the present invention.

The modified pin biasing springs 226, illustrated in FIGS. 23 and 25, include a non-constant diameter, with the last few coils at each end of the springs 226 having a reduced diameter. The tapering allows for a greater spring force in a smaller physical height.

Figure 26A:
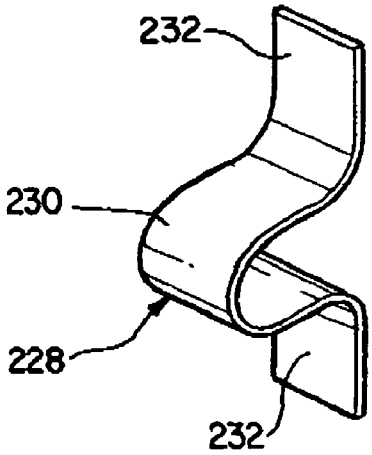
FIGS. 26*a*–26*b* are views of an alternative embodiment of the spring catch.
Figure 26B:
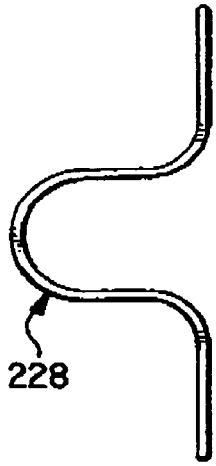
Figure 27A:
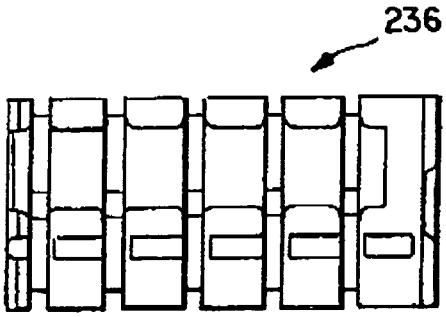
FIGS. 27*a*–27*e* are views of an alternative embodiment of the carrier.
Figure 27B:
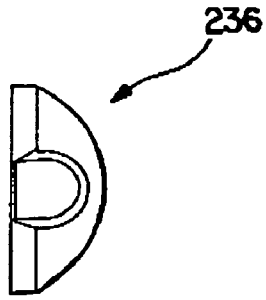
Figure 27C:
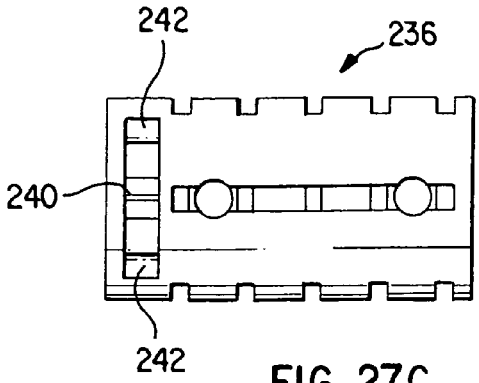
Figure 27D:
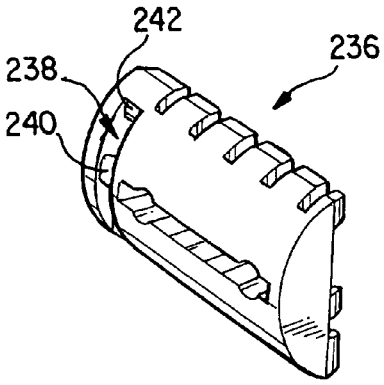
Figure 27E:
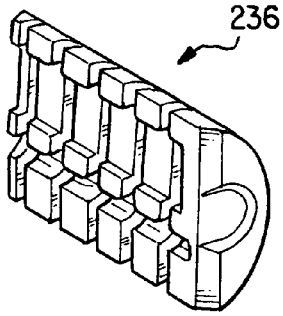

The modified spring catch 228, illustrated in FIGS. 23 and 26, includes a central U-shaped portion 230 and a pair of arms 232 extending from the U-shaped portion 230.

The modified carrier 236, illustrated in FIGS. 23 and 27, includes means for retaining the spring catch 228 in the spring catch recess 238. In the illustrated embodiment, this includes a guide 240 projecting outwardly in the center of the spring catch recess 238 and a pair of anchors 242 radially offset from the guide 240. The guide 240 prevents the spring catch 228 from moving transversely in the recess 238 while permitting it to move radially outwardly to engage the housing 12, 212 as described above. The anchors 242 engage the arms 232 of the spring catch 228 and prevent the arms 232 from splaying outwardly, thereby directing the compressive force of the spring catch 228 to extend the U-shaped portion 230 outwardly to engage the housing 12, 212.

Figure 28A:
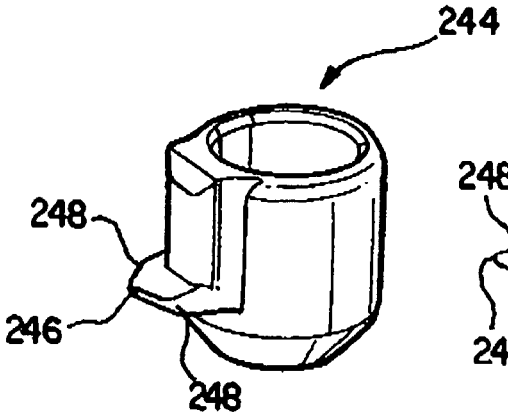
FIGS. 28*a*–28*b* are views of an alternative embodiment of the pin.
Figure 28B:
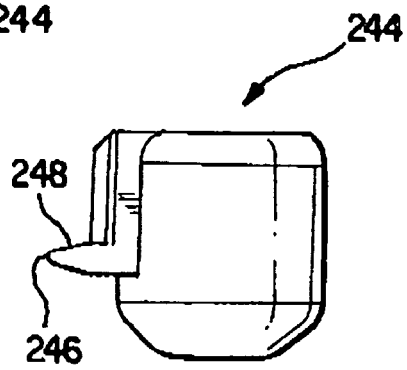

The modified pins 244, illustrated in FIGS. 23 and 28, include a single gear tooth 246 instead of the plurality of gear teeth of the pins 113 described above. The single gear tooth 246, which preferably includes beveled sides 248, provides for a smoother engagement with the racks during the rekeying process.

Figure 29A:
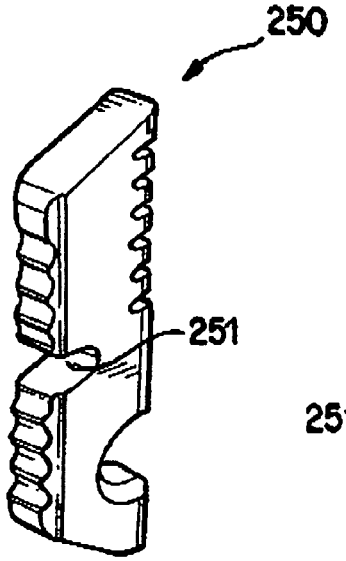
FIGS. 29*a*–29*b* are views of an alternative embodiment of the rack.
Figure 29B:
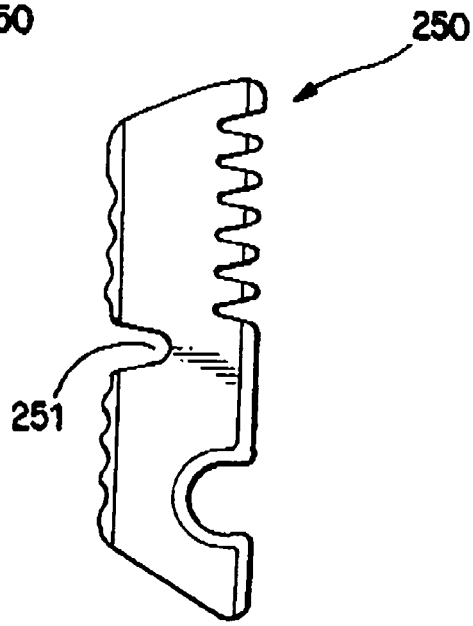

The modified racks 250, illustrated in FIGS. 23 and 29, include beveled gear teeth to improve the engagement with the pins during the rekeying process. In addition, the pair of locking bar-engaging grooves 132 in the racks 92 are replaced with a single locking bar-engaging groove 251.

Figure 30A:
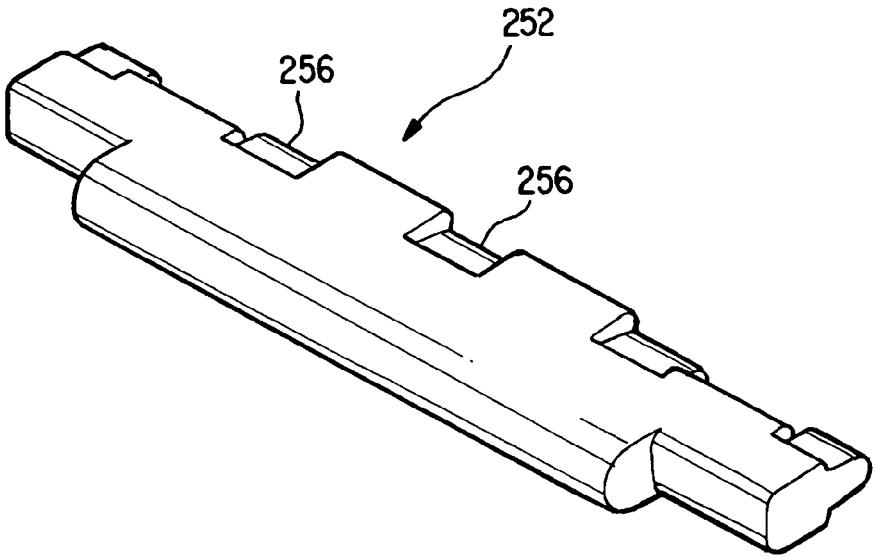
FIGS. 30*a*–30*b* are views of an alternative embodiment of the locking bar.
Figure 30B:
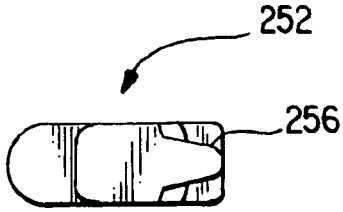

The modified locking bar 252, illustrated in FIGS. 23 and 30, is thinner than locking bar 94 and replaces the pair of gear teeth 136 with a single gear tooth 256 and rounds out the triangular edge 134. The thinner design reduces any rocking of the locking bar 252 in the locking bar recess 106.

The above-described embodiments, of course, are not to be construed as limiting the breadth of the present invention. Modifications and other alternative constructions will be apparent that are within the spirit and scope of the invention as defined in the appended claims.

The invention claimed is:

1. A rekeyable lock cylinder comprising:
a cylinder body with a longitudinal axis;
a plurality of pins disposed in the cylinder body; and
a carrier sub-assembly disposed in the cylinder body and including a carrier and
a plurality of racks for engaging the pins, the carrier sub-assembly being moveable parallel to the longitudinal axis of the cylinder body between a first position and a second position to disengage the racks from the pins.

2. The lock cylinder of claim 1 further comprising
a plug assembly containing the plurality of pins, the carrier sub-assembly containing the plurality of racks for engaging the plurality of pins.

3. The lock cylinder of claim 1 wherein the racks disengage from the pins in response to movement of the carrier from the first position to the second position and engage the pins in response to movement of the carrier from the second position to the first position, the lock cylinder being in a rekeyable condition when the carrier is in the second position.

4. The lock cylinder of claim 1 wherein each pin includes at least one gear tooth.

5. The lock cylinder of claim 1 wherein each of the plurality of pins includes a hollow cup-shaped body.

6. The lock cylinder of claim 1 further comprising a plurality of springs, the plurality of springs having a non-constant diameter.

7. The lock cylinder of claim 6 wherein the pins are cup-shaped and configured to receive the plurality of springs.

8. The lock cylinder of claim 1 further comprising a spring catch for retaining the carrier in the second position.

9. The lock cylinder of claim 8 wherein the spring catch includes a U-shaped center portion and a pair of arms extending from the center portion.

10. The lock cylinder of claim 9 wherein the carrier sub-assembly further includes a spring-catch recess, the recess including a guide configured to receive the U-shaped center portion of the spring catch and a pair of anchors configured to engage the pair of arms.

11. The lock cylinder of claim 8 wherein the cylinder body includes a groove for receiving the spring catch when the carrier sub-assembly is in the second position.

12. The lock cylinder of claim 8 wherein the spring catch moves from an engaging position, wherein the spring catch retains the carrier sub-assembly in the second position, to a disengaged position in response to rotation of the carrier sub-assembly in the cylinder body.

13. The lock cylinder of claim 1 wherein each rack includes at least one locking bar-receiving groove and a plurality of pin-engaging gear teeth and each pin includes at least one gear tooth for engaging the rack between two of the plurality of pin-engaging gear teeth.

14. The lock cylinder of claim 1 wherein the carrier sub-assembly further includes a carrier having a plurality of rack-receiving slots and a locking bar recess.

15. A rekeyable lock cylinder comprising:

a cylinder body with a longitudinal axis;

a plug assembly including a plurality of racks selectively engageable with a plurality of pins; and means for changing the lock cylinder between a rekeying condition and an operating condition, the means for changing being configured to move the plurality of racks in the cylinder body parallel to, transversely to, and rotationally about the longitudinal axis of the cylinder body to disengage the racks from the pins.

16. The lock cylinder of claim 15 wherein the means for changing includes means for preventing rotational movement of the racks and pins about the longitudinal axis.

17. The lock cylinder of claim 16 wherein the means for preventing includes means for locking the plug assembly against rotation in the cylinder body.

18. The lock cylinder of claim 15 wherein the means for changing includes a carrier movable between a first position and a second position and means for biasing the carrier toward the first position.

19. The lock cylinder of claim 18 wherein the plug assembly includes the carrier configured to engage the plurality of racks, the racks being engaged with the pins when the carrier is in the first position and disengaged from the pins when the carrier is in the second position.

20. The lock cylinder of claim 18 wherein the means for changing includes means for engaging the cylinder body to retain the carrier in the second position.

21. The lock cylinder of claim 20 wherein the means for engaging is configured to disengage from the cylinder body in response to rotation of the plug assembly in the cylinder body.

22. A rekeyable lock cylinder comprising:

a cylinder body with a longitudinal axis;

a plurality of pins disposed in the cylinder body; and a plurality of racks for engaging the plurality of pins, the racks being configured to disengage from the pins in response to movement in the cylinder body parallel to, transversely to, and rotationally about the longitudinal axis.

23. The lock cylinder of claim 22 further including a plug body having a locking bar movable between a locked position and an unlocked position, wherein the plug body is rotatable in the cylinder body to a rekeying position when the locking bar is in the unlocked position and the racks can be disengaged from the pins in the rekeying position.

24. The lock cylinder of claim 22 wherein each pin includes at least one gear tooth for engaging one of the plurality of racks.

25. The lock cylinder of claim 24 further including a biasing spring disposed against each of the plurality of pins, each biasing spring having a non-constant diameter.

26. The lock cylinder of claim 25 wherein each of the plurality of pins includes a cup-shaped body f0r receiving the biasing spring.

27. A rekeyable lock cylinder comprising:

a plug body having a longitudinal axis and a plurality of pins; and a plurality of racks disposed to engage the pins, the racks being disengaged from the pins in response to movement of the racks transversely to, rotationally about and parallel to the longitudinal axis.

28. The lock cylinder of claim 27 further comprising a carrier having a plurality of slots for receiving the racks, the carrier being movable longitudinally between a first position and a second position, the racks being engaged with the pins in the first position and disengaged from the pins in the second position.

29. The lack cylinder of claim 28 wherein the carrier is rotated about the longitudinal axis from a home position to the first position and longitudinally from the first position to the second position.

30. A rekeyable lock cylinder comprising:

a cylinder body with a longitudinal axis;

a plurality of pins; and a plurality of racks for engaging the plurality of pins, the racks being movable parallel to, transversely to, and rotationally about the longitudinal axis to disengage from the pins.

31. The lock cylinder of claim 30 further including a carrier configured to carry the plurality of racks and a plug with a face having a keyway and a rekeying tool-receiving aperture, the carrier being movable parallel to the longitudinal axis in response to insertion of a rekeying tool into the rekeying tool-receiving aperture.

32. The lock cylinder of claim 31 further including a locking bar movable between a locking position and an unlocking position, wherein the carrier is rotatable in the cylinder body to a rekeying position when the locking bar is in an unlocking position and is movable longitudinally when the carrier is in the rekeying position.

33. The lock cylinder of claim 30 wherein each pin includes at least one gear tooth for engaging one of the plurality of racks.

34. The lack cylinder of claim 30 further including a biasing spring disposed against each of the plurality of pins, each biasing spring having a non-constant diameter.

35. The lock cylinder of claim 34 wherein each of the plurality of pins includes a cup-shaped body for receiving the biasing spring.

36. A rekeyable lock cylinder comprising:

a cylinder body with a longitudinal axis;

a plug body disposed in the cylinder body and having a face with a keyway and a tool-receiving aperture;

a carrier disposed in the plug body; and a first valid key configured to be received in the keyway, the plug body being rotatable between a first position and a rekeying position when the first valid key is disposed in the keyway, the carrier moving longitudinally in response to the insertion of a rekeying tool into the tool-receiving aperture, the first valid key being removable from the plug body after the tool is inserted in the tool-receiving aperture.

* * * * *